US007276102B2

(12) United States Patent
Johnson, Jr. et al.

(10) Patent No.: US 7,276,102 B2
(45) Date of Patent: Oct. 2, 2007

(54) MOLYBDENUM METAL POWDER AND PRODUCTION THEREOF

(75) Inventors: Loyal M. Johnson, Jr., Tucson, AZ (US); Sunil Chandra Jha, Oro Valley, AZ (US); Carl Cox, Tucson, AZ (US); Patrick Ansel Thompson, Tucson, AZ (US)

(73) Assignee: Climax Engineered Materials, LLC, Phoenix, AZ (US)

( * ) Notice: Subject to any disclaimer, the term of this patent is extended or adjusted under 35 U.S.C. 154(b) by 89 days.

(21) Appl. No.: 10/970,456

(22) Filed: Oct. 21, 2004

(65) Prior Publication Data

US 2006/0086205 A1 Apr. 27, 2006

(51) Int. Cl.
*B22F 1/00* (2006.01)
*B22F 9/18* (2006.01)

(52) U.S. Cl. ..... 75/255; 75/369

(58) Field of Classification Search ..... 75/255, 75/369, 623, 363

See application file for complete search history.

(56) References Cited

U.S. PATENT DOCUMENTS

| | | | | |
|---|---|---|---|---|
| 2,398,114 | A | 4/1946 | Rennie | |
| 2,402,084 | A | 6/1946 | Rennie | |
| 2,776,887 | A | 1/1957 | Kelly, Jr. et al. | |
| 3,264,098 | A | 8/1966 | Heytmeijer | |
| 3,407,057 | A * | 10/1968 | Timmons | 420/429 |
| 3,865,573 | A | 2/1975 | Neumann et al. | |
| 3,907,546 | A | 9/1975 | Port et al. | |
| 4,045,216 | A | 8/1977 | Meyer et al. | |
| 4,552,749 | A | 11/1985 | McHugh | |
| 4,595,412 | A | 6/1986 | Brunelli et al. | |
| 4,612,162 | A | 9/1986 | Morgan et al. | |
| 4,613,371 | A | 9/1986 | Cheney et al. | |
| 4,622,068 | A | 11/1986 | Rowe et al. | |
| 4,724,128 | A | 2/1988 | Cheresnowsky et al. | |
| 4,915,733 | A | 4/1990 | Schiitz et al. | |
| 5,063,021 | A | 11/1991 | Anand et al. | |
| 5,330,557 | A | 7/1994 | May | |
| 6,447,571 | B1 | 9/2002 | Ito et al. | |
| 6,569,222 | B2 | 5/2003 | McCormick | |
| 6,626,976 | B2 | 9/2003 | Khan et al. | |
| 6,793,907 | B1 * | 9/2004 | Singh et al. | 423/593.1 |
| 6,923,842 | B2 | 8/2005 | Furuya | |
| 2001/0009118 | A1 | 7/2001 | Hosoe et al. | |
| 2001/0049981 | A1 | 12/2001 | Mccormick | |
| 2003/0084754 | A1 | 5/2003 | Khan et al. | |
| 2004/0206204 | A1 | 10/2004 | Holmqvist et al. | |
| 2005/0061106 | A1 | 3/2005 | Ibaraki et al. | |

FOREIGN PATENT DOCUMENTS

| | | |
|---|---|---|
| JP | 58-113369 | 7/1983 |
| JP | 61-201708 | 9/1986 |
| JP | 09-125101 | 5/1997 |
| JP | 2003-193152 | 7/2003 |

* cited by examiner

*Primary Examiner*—Roy King
*Assistant Examiner*—Ngoclan T. Mai
(74) *Attorney, Agent, or Firm*—Bruce E. Dahl; Susan E. Chetlin

(57) ABSTRACT

Molybdenum metal powder, and method for production thereof. Molybdenum metal powder has surface-area-to-mass-ratios in a range of between about 1.0 meters$^2$/gram ($m^2/g$) and about 3.0 $m^2/g$, as determined by BET analysis, in combination with a particle size wherein at least 30% of the particles have a particle size larger than a size +100 standard Tyler mesh sieve. In addition, molybdenum metal powder 10 may be further distinguished by flowability in a range of between about 29 seconds/50 grams (s/50 g) and about 64 s/50 g, as determined by a Hall Flowmeter. A method of producing molybdenum powder may comprise providing a supply of ammonium molybdate, heating the ammonium molybdate at an initial temperature in the presence of a reducing gas to produce an intermediate product, and heating the intermediate product at a final temperature in the presence of the reducing gas, producing molybdenum metal powder.

20 Claims, 11 Drawing Sheets

Molybdenum metal power produced using AHM as the the ammonium molybdate precursor material.

Molybdenum metal power produced using AHM as the the ammonium molybdate precursor material.

Molybdenum metal power produced using AHM as the the ammonium molybdate precursor material.

Molybdenum metal power produced using ADM as the the ammonium molybdate precursor material.

Molybdenum metal power produced using ADM as the the ammonium molybdate precursor material.

Molybdenum metal power produced using ADM as the the ammonium molybdate precursor material.

Molybdenum metal power produced using AOM as the the ammonium molybdate precursor material.

Molybdenum metal power produced using AOM as the the ammonium molybdate precursor material.

Molybdenum metal power produced using AOM as the the ammonium molybdate precursor material.

MOLYBDENUM METAL POWDER AND PRODUCTION THEREOF

FIELD OF THE INVENTION

The invention generally pertains to molybdenum, and more specifically, to molybdenum metal powder and production thereof.

BACKGROUND OF THE INVENTION

Molybdenum (Mo) is a silvery or platinum colored metallic chemical element that is hard, malleable, ductile, and has a high melting point, among other desirable properties. Molybdenum occurs naturally in a combined state, not in a pure form. Molybdenum ore exists naturally as molybdenite (molybdenum disulfide, $MoS_2$).

Molybdenum ore may be processed by roasting to form molybdic oxide ($MoO_3$), which may be further processed to form pure molybdenum (Mo) metal powder. In its pure state, molybdenum metal is tough and ductile and is characterized by moderate hardness, high thermal conductivity, high resistance to corrosion, and a low expansion coefficient. Molybdenum metal may be used for electrodes in electrically heated glass furnaces, nuclear energy applications, and for casting parts used in missiles, rockets, and aircraft. Molybdenum metal may also be used in various electrical applications that are subject to high temperatures, such as X-ray tubes, electron tubes, and electric furnaces.

SUMMARY OF THE INVENTION

Molybdenum metal powder has surface-area-to-mass-ratios in a range of between about 1.0 meters$^2$/gram ($m^2$/g) and about 3.0 $m^2$/g, as determined by BET analysis, in combination with a particle size wherein at least 30% of the particles have a particle size larger than a size +100 standard Tyler mesh sieve. The molybdenum metal powder may be further distinguished by flowability in a range of between about 29 seconds/50 grams (s/50 g) and about 64 s/50 g, as determined by a Hall Flowmeter. Molybdenum metal powder may also be distinguished by its relatively low sintering temperature, wherein the molybdenum metal powder begins to sinter at about 950° C. The molybdenum metal powder has a final weight percent of oxygen less than about 0.2%.

A method for producing molybdenum metal powder may comprise: i) providing a supply of ammonium molybdate; ii) heating the ammonium molybdate at an initial temperature in the presence of a reducing gas, such as hydrogen, to produce an intermediate product; iii) heating the intermediate product at a final temperature in the presence of the reducing gas; and iv) producing molybdenum metal powder having surface-area-to-mass-ratios in the range of between about 1.0 $m^2$/g and about 3.0 $m^2$/g, as determined by BET analysis, and a particle size wherein at least 30% of the particles have a particle size larger than a size +100 standard Tyler mesh sieve.

BRIEF DESCRIPTION OF THE DRAWINGS

Illustrative and presently preferred embodiments of the invention are illustrated in the drawings, in which.

DETAILED DESCRIPTION OF THE INVENTION

Novel molybdenum metal powder 10 has surface-area-to-mass-ratios in a range of between about 1.0 meters$^2$/gram ($m^2$/g) and about 3.0 $m^2$/g, as determined by BET analysis, in combination with a particle size wherein at least 30% of the particles have a particle size larger than a size +100 standard Tyler mesh sieve. In addition, molybdenum metal powder 10 may be further distinguished by flowability in a range of between about 29 seconds/50 grams (s/50 g) and about 64 s/50 g, as determined by a Hall Flowmeter; the temperature at which sintering begins; and the weight percent of oxygen present in the final product.

Molybdenum metal powder 10 having a relatively high surface-area-to-mass-ratio in combination with a relatively large particle size and excellent flowability provides advantages in subsequent powder metallurgy processes. For example, the low Hall flowability (i.e. a very flowable material) of the molybdenum metal powder 10 produced according to the present invention is advantageous in sintering processes because the molybdenum metal powder 10 will more readily fill mold cavities. The comparatively low sintering temperature (e.g. of about 950° C.) compared to about 1500° C. for conventional molybdenum metal powders, provides additional advantages as described herein.

Figure 1:
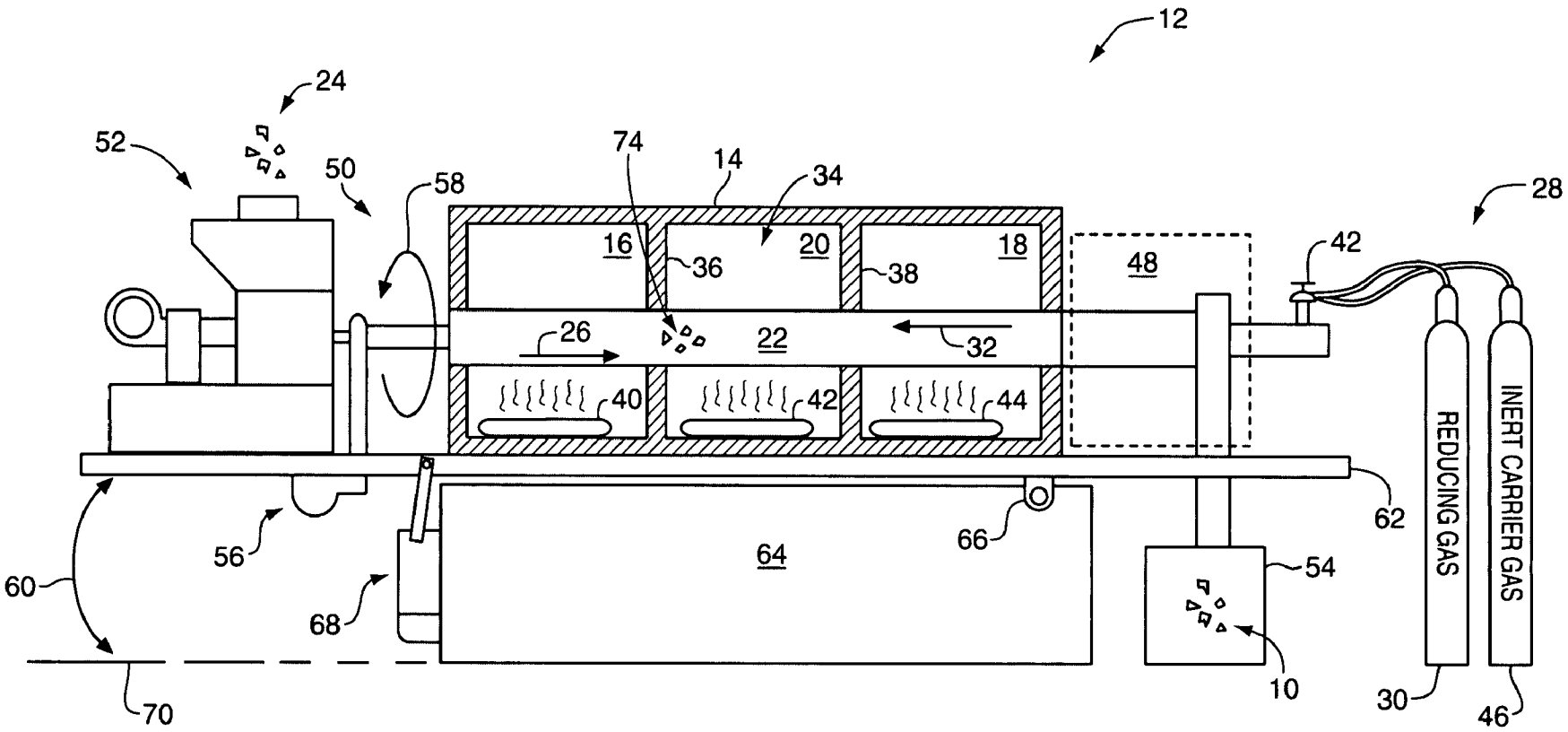
FIG. 1 is a cross-sectional schematic representation of one embodiment of an apparatus for producing molybdenum metal powder according to the invention.

The novel molybdenum metal powder 10 may be produced by apparatus 12 illustrated in FIG. 1. Apparatus 12 may comprise a furnace 14 having an initial heating zone 16, and a final heating zone 18. Optionally, the furnace 14 may be provided with an intermediate heating zone 20 located between the initial heating zone 16 and the final heating zone 18. A process tube 22 extends through the furnace 14 so that an ammonium molybdate precursor material 24 may be introduced into the process tube 22 and moved through the heating zones 16, 18, 20 of the furnace 14, such as is illustrated by arrow 26 shown in FIG. 1. A process gas 28, such as a hydrogen reducing gas 30, may be introduced into the process tube 22, such as is illustrated by arrow 32 shown in FIG. 1. Accordingly, the ammonium molybdate precursor material 24 is reduced to form or produce molybdenum metal powder 10.

A method 80 (FIG. 2) for production of the molybdenum metal powder 10 is also disclosed herein. Molybdenum metal powder 10 is produced from an ammonium molybdate precursor material 24. Examples of ammonium molybdate precursor materials 24 include ammonium heptamolybdate (AHM), ammonium dimolybdate (ADM), and ammonium octamolybdate (AOM). A method 80 for producing molybdenum metal powder 10 may comprise: i) providing 82 a supply of ammonium molybdate precursor material 24; ii) heating 84 the ammonium molybdate precursor material 24 at an initial temperature (e.g., in initial heating zone 16 of furnace 14) in the presence of a reducing gas 30, such as hydrogen, to produce an intermediate product 74; iii) heating 86 the intermediate product 74 at a final temperature (e.g., in final heating zone 18 of furnace 14) in the presence of the reducing gas 30; and iv) producing 88 molybdenum metal powder 10.

Having generally described the molybdenum metal powder 10, apparatus 12, and methods 80 for production thereof, as well as some of the more significant features and advantages of the invention, the various embodiments of the invention will now be described in further detail.

Novel Forms of Molybdenum Metal Powder

Novel molybdenum metal powder 10 has surface-area-to-mass-ratios in a range of between about 1.0 meters$^2$/gram ($m^2/g$) and about 3.0 $m^2/g$, as determined by BET analysis, in combination with a particle size wherein at least 30% of the particles have a particle size larger than a size +100 standard Tyler mesh sieve. In addition, molybdenum metal powder 10 may be further distinguished by flowabilities in a range of between about 29 seconds/50 grams (s/50 g) and about 64 s/50 g, as determined by a Hall Flowmeter; the temperature at which sintering begins, and the weight percent of oxygen present in the final product. As can readily be seen in FIGS. 4, 7, & 10, the combination of these unique characteristics, results in particles of novel molybdenum metal powder 10 having a generally round ball-like appearance with a very porous surface, similar to that of a round sponge.

The molybdenum metal powder 10 may have surface-area-to-mass-ratios in a range of between about 1.0 meters$^2$/gram ($m^2/g$) and about 3.0 $m^2/g$, as determined by BET analysis. More specifically, the molybdenum metal powder 10 may have surface-area-to-mass-ratios in the range of between about 1.32 $m^2/g$ and about 2.56 $m^2/g$, as determined by BET analysis. The high BET results are obtained even though the particle size is comparatively large (i.e. about 60 μm or 60,000 nm). Comparatively high BET results are more commonly associated with nano-particles having sizes considerably smaller than 1 μm (1,000 nm). Here, the molybdenum metal powder 10 particles are quite novel because the particles are considerably larger, having sizes of about 60 μm (60,000 nm), in combination with high BET results between about 1.32 $m^2/g$ and about 2.56 $m^2/g$.

The molybdenum metal powder 10 particles have a particle size wherein at least 30% of the particles have a particle size larger than a size +100 standard Tyler mesh sieve. More specifically, the molybdenum metal powder 10 particles have a particle size wherein at least 40% of the particles have a particle size larger than a size +100 standard Tyler mesh sieve. Additionally, the molybdenum metal powder 10 particles have a particle size wherein at least 20% of the particles have a particle size smaller than a size −325 standard Tyler mesh sieve. Standard Tyler screen sieves with diameters of 8 inches were used to obtain the results herein.

The unique combination of high BET and larger particle size can readily be seen in FIGS. 3-11, illustrating the porous particle surface, which is similar in appearance to that of a sponge. The porous surface of the molybdenum metal powder 10 particles increases the surface-area-to-mass-ratio of the particles, providing the higher BET results. In contrast, molybdenum metal powder 10 particles that may be produced according to prior art processes have a generally smooth surface (i.e. nonporous), resulting in relatively low surface-area-to-mass-ratios (i.e. low BET results).

The relatively large particle size in combination with the approximately spherical shape of the particles contributes to low Hall flowability, making the molybdenum metal powder 10 a very flowable material and thus a good material for subsequent sintering and other powder metallurgy applications. Molybdenum metal powder 10 has flowability between about 29 s/50 g and about 64 s/50 g as determined by a Hall Flowmeter. More specifically, flowability of between about 58 s/50 g and about 63 s/50 g was determined by a Hall Flowmeter.

The molybdenum metal powder 10 may also be distinguished by its final weight percent of oxygen. Molybdenum metal powder 10 comprises a final weight percent of oxygen less than about 0.2%. Final weight percent of oxygen less than about 0.2% is a particularly low oxygen content, which is desirable for many reasons. Lower weight percent of oxygen enhances subsequent sintering processes. A higher weight percent of oxygen can often react negatively with the hydrogen gas used in the sintering furnace and produce water, or lead to higher shrinkage and or structure problems, such as vacancies. The identification of molybdenum metal powder 10 with such an advantageous weight percent of oxygen contributes to increased manufacturing efficiency.

Additionally, molybdenum metal powder 10 may be distinguished by the temperature at which sintering begins. The molybdenum metal powder 10 begins to sinter at about 950° C., which is a notably low temperature for sintering molybdenum metal. Typically, conventionally produced molybdenum metal powder does not begin to sinter until about 1500° C. The ability of the molybdenum metal powder 10 to be highly flowable and begin to sinter at such low temperatures has significant advantages including, for example, decreasing manufacturing expenses, increasing manufacturing efficiency, and reducing shrinkage.

Molybdenum metal powder 10 may have slightly different characteristics than those specifically defined above (e.g.

surface-area-to-mass-ratio, particle size, flowability, oxygen content, and sintering temperature) depending upon the ammonium molybdate precursor material 24 used to produce the molybdenum metal powder 10. The ammonium molybdate precursor materials 24 which have been used with good results to produce molybdenum metal power 10 include ammonium dimolybdate $(NH_4)_2Mo_2O_7$ (ADM), ammonium heptamolybdate $(NH_4)_6Mo_7O_{24}$ (AHM), and ammonium octamolybdate $(NH_4)_4Mo_8O_{26}$ (AOM).

While the best results have been obtained utilizing AHM as the ammonium molybdate precursor material 24, ADM and AOM have also been used with good results. The ammonium molybdate precursor materials 24 are produced by and commercially available from Climax Molybdenum Company in Fort Madison, Iowa.

Figure 3:
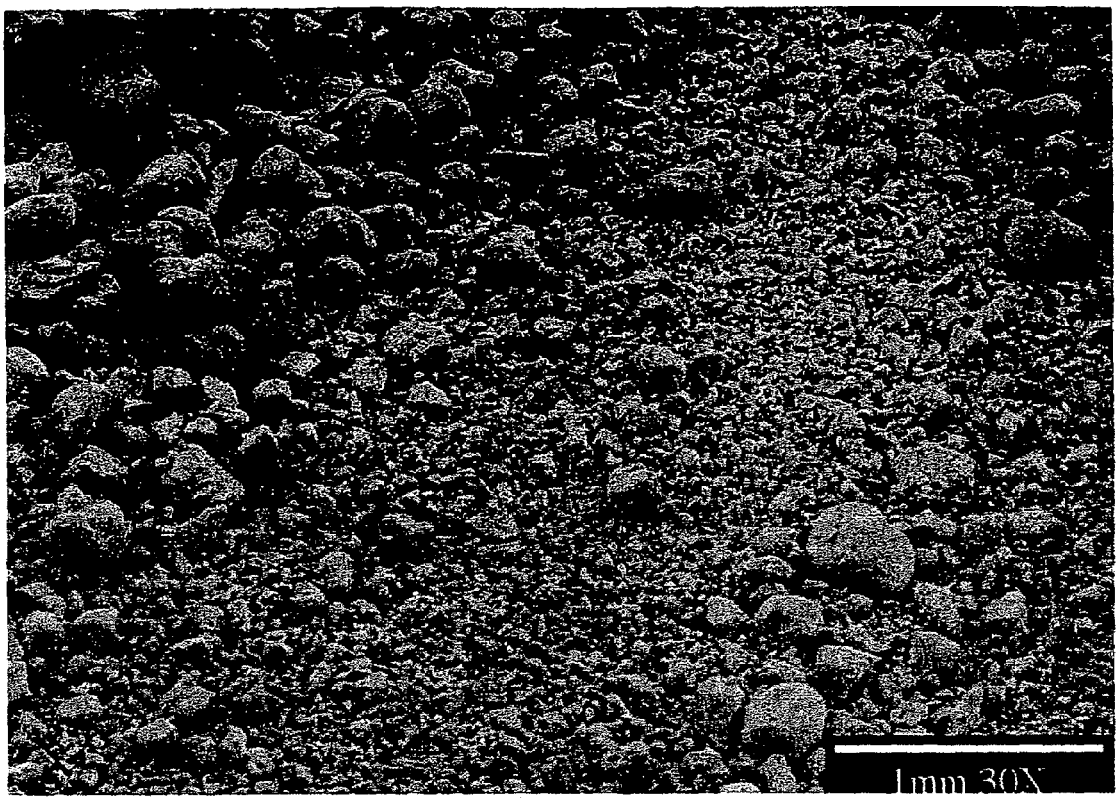
FIG. 3 is a scanning electron microscope image of the molybdenum metal powder such as may be produced according to one embodiment of the present invention wherein the ammonium molybdate precursor material is AHM.
Figure 4:
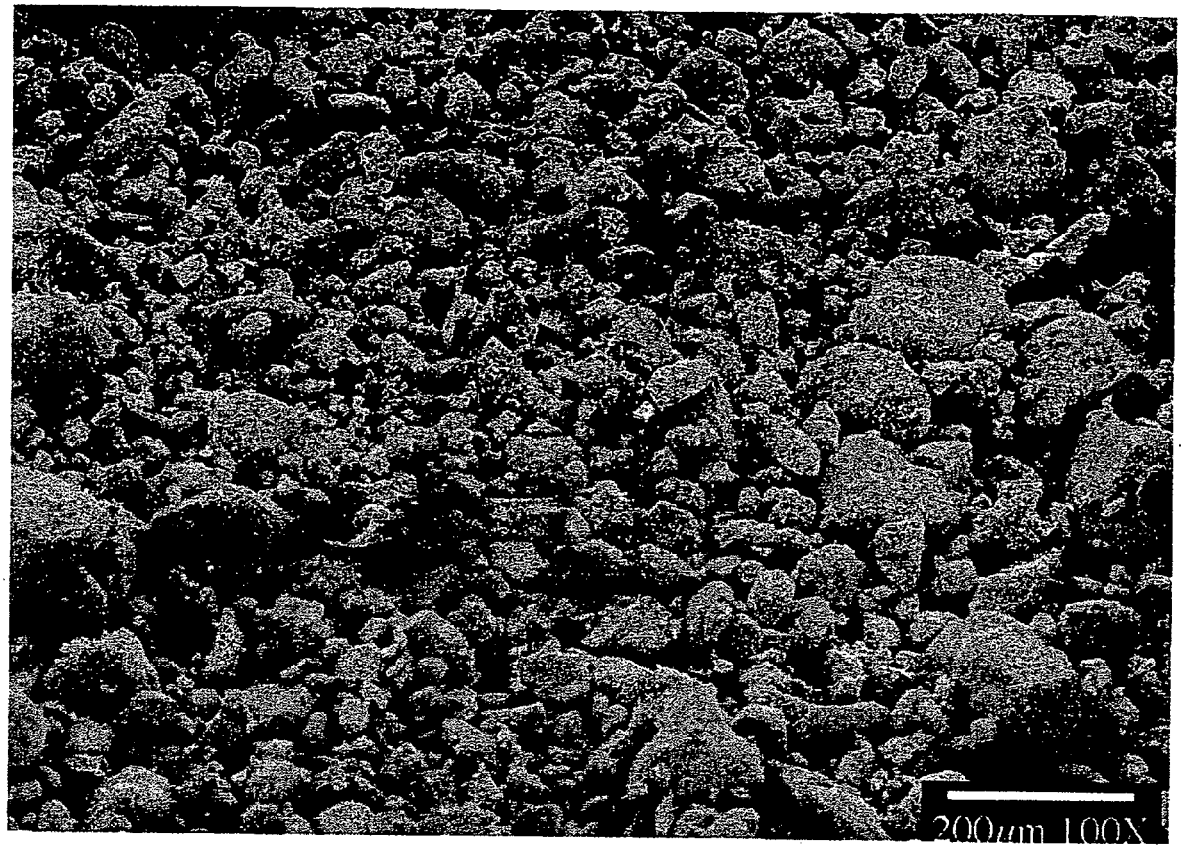
FIG. 4 is a scanning electron microscope image of the molybdenum metal powder such as may be produced according to one embodiment of the present invention wherein the ammonium molybdate precursor material is AHM.
Figure 5:
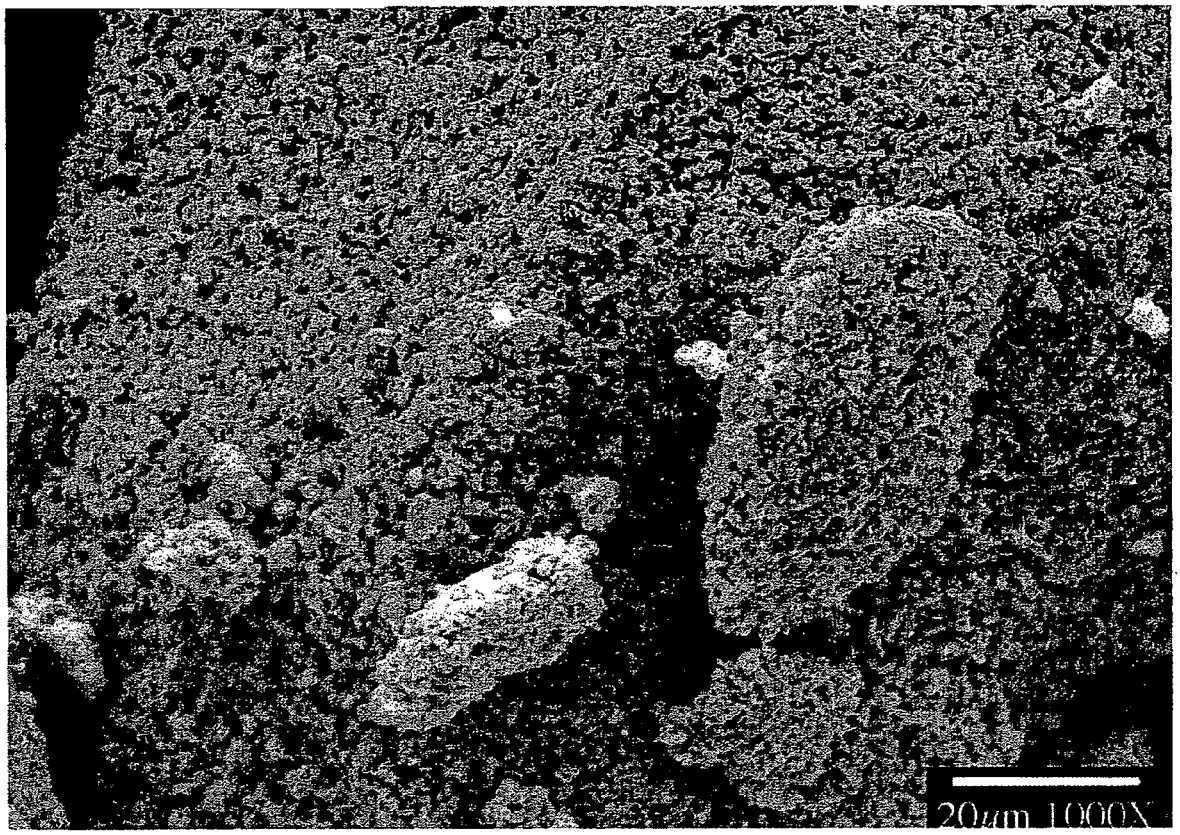
FIG. 5 is a scanning electron microscope image of the molybdenum metal powder such as may be produced according to one embodiment of the present invention wherein the ammonium molybdate precursor material is AHM.

FIGS. 3-5 are scanning electron microscope images of molybdenum metal powder 10 such as may be produced according to one embodiment of the present invention wherein the ammonium molybdate precursor material 24 was AHM. AHM is produced by and is commercially available from Climax Molybdenum Company in Fort Madison, Iowa (CAS No: 12054-85-2).

Generally, AHM may be an advantageous ammonium molybdate precursor material 24 when the final product desired must have a relatively low oxygen content and be highly flowable for applications such as sintering, for example. Using AHM as the ammonium molybdate precursor material 24 generally results in a more spherical molybdenum metal powder 10, as shown in FIGS. 3 & 4. The spherical shape of the molybdenum metal powder 10 contributes to the high flowability (i.e. it is a very flowable material) and excellent sintering ability. The porous surface of the molybdenum metal powder 10 produced from AHM increases the surface-area-to-mass-ratio and can readily been seen in FIG. 5. Generally, molybdenum metal powder 10 produced from AHM is more flowable and has a lower oxygen content than molybdenum metal powder 10 produced from AOM or ADM.

Figure 6:
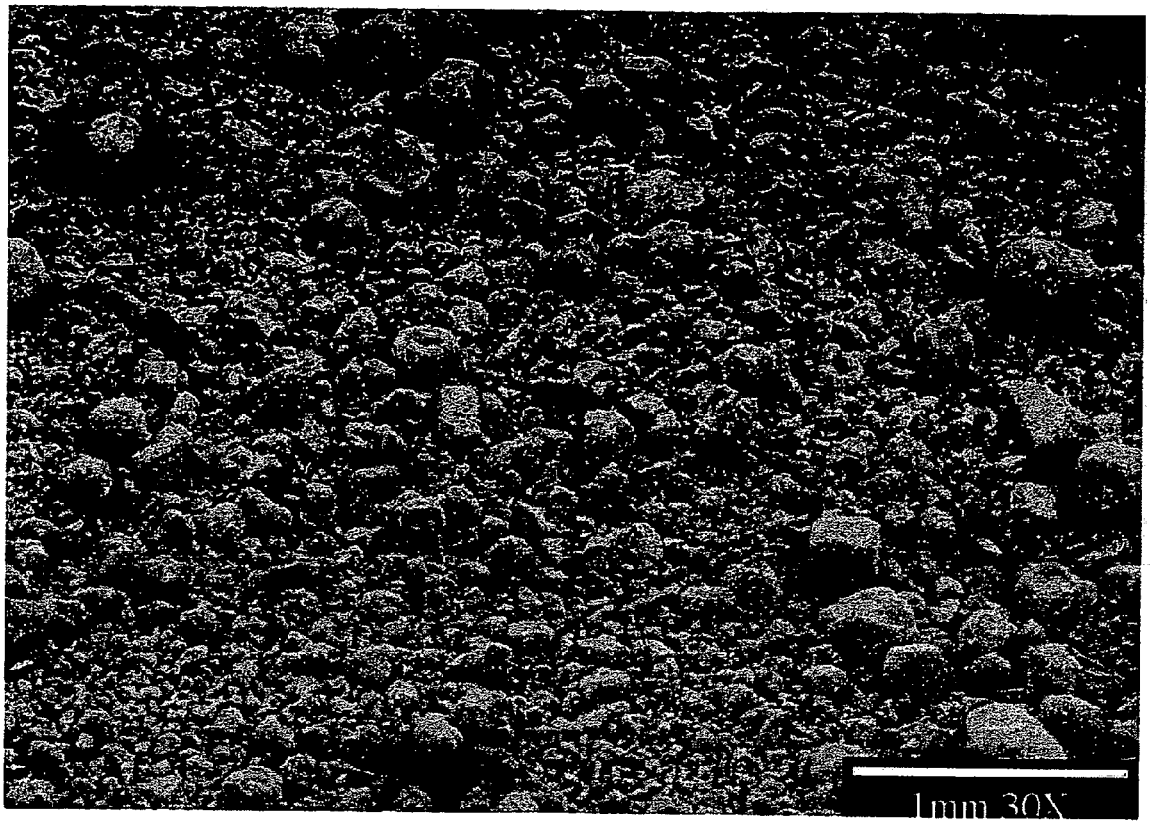
FIG. 6 is a scanning electron microscope image of the molybdenum metal powder such as may be produced according to one embodiment of the present invention wherein the ammonium molybdate precursor material is ADM.
Figure 7:
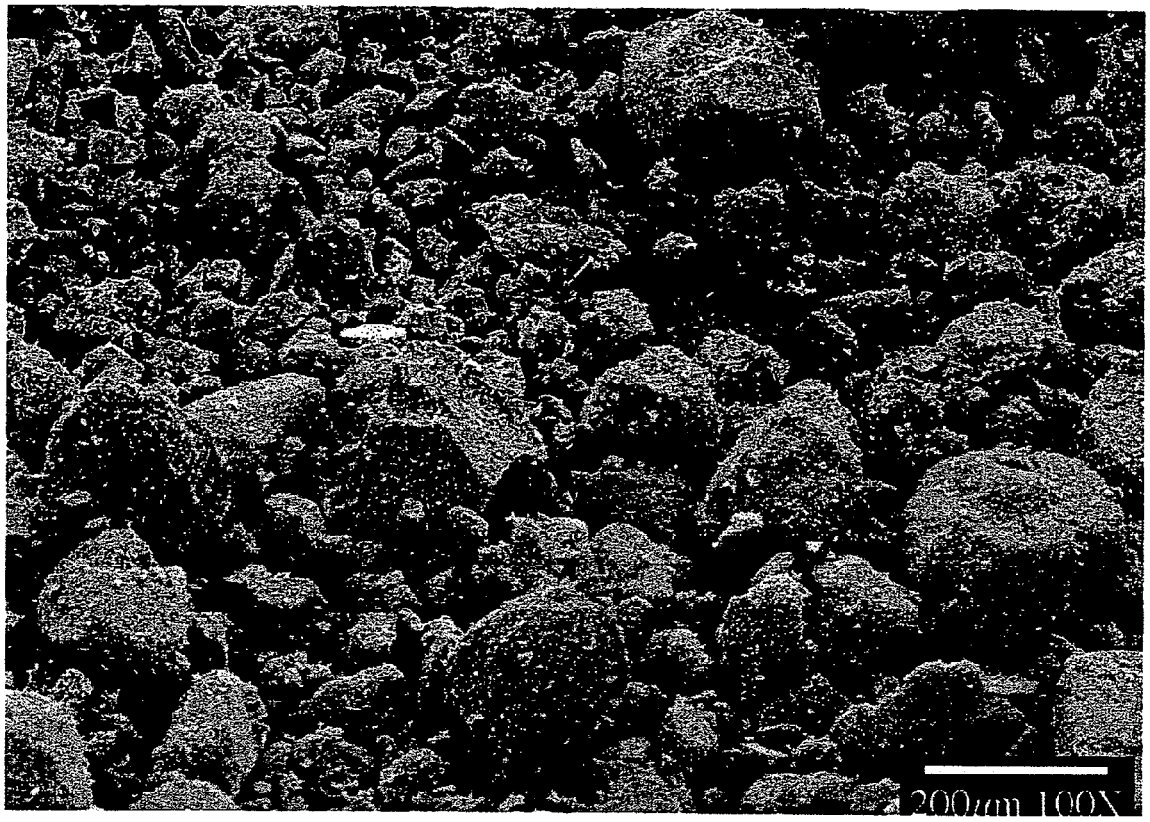
FIG. 7 is a scanning electron microscope image of the molybdenum metal powder such as may be produced according to one embodiment of the present invention wherein the ammonium molybdate precursor material is ADM.
Figure 8:
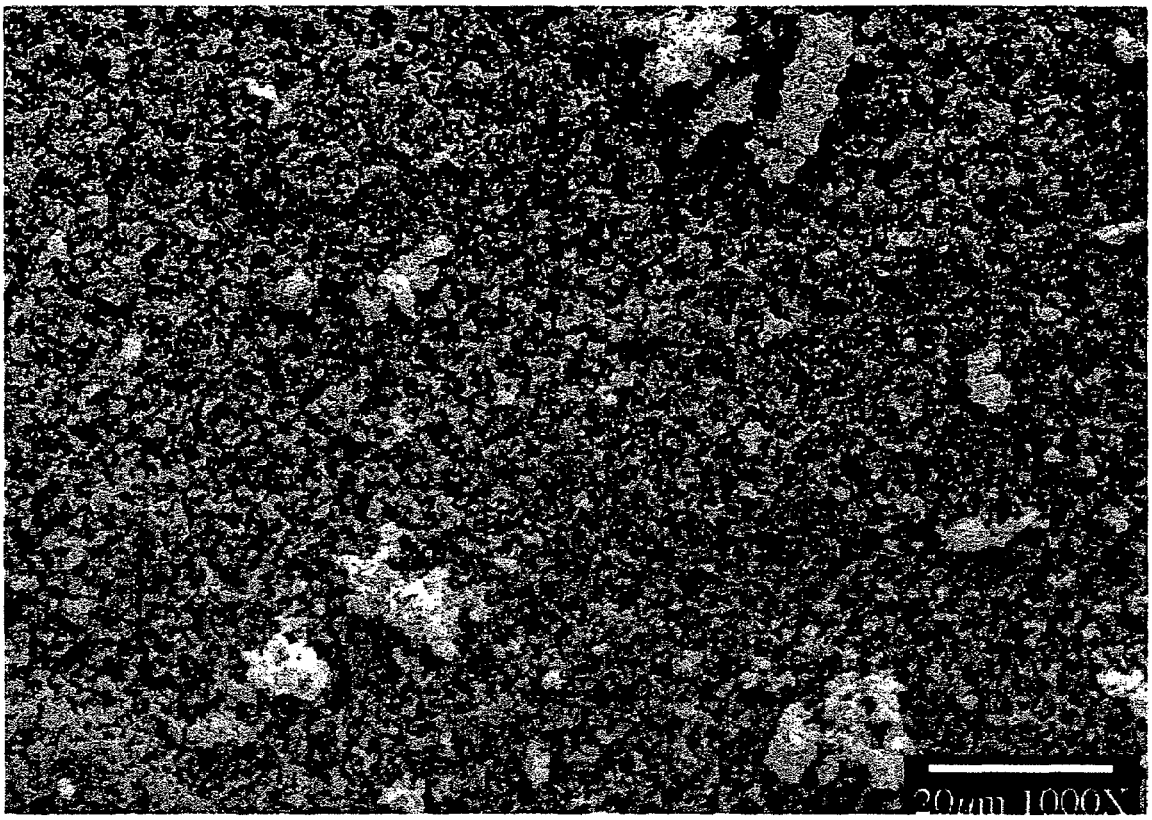
FIG. 8 is a scanning electron microscope image of the molybdenum metal powder such as may be produced according to one embodiment of the present invention wherein the ammonium molybdate precursor material is ADM.

FIGS. 6-8 are scanning electron microscope images of molybdenum metal powder 10 such as may be produced according to one embodiment of the present invention wherein the ammonium molybdate precursor material 24 was ADM. ADM is produced by and is commercially available from Climax Molybdenum Company in Fort Madison, Iowa (CAS No: 27546-07-2).

Using ADM as the ammonium molybdate precursor material 24 generally results in a more coarse molybdenum metal power 10 than that produced from AHM, as seen in FIGS. 6 & 7. Molybdenum metal powder 10 produced from ADM also has a higher oxygen content and a lower flowability (as shown in Example 13) compared to molybdenum metal powder 10 produced from AHM. The porous surface of the molybdenum metal powder 10 produced from ADM increases the surface-area-to-mass-ratio and can readily been seen in FIG. 8. Generally, the molybdenum metal powder 10 produced from ADM has a combination of high BET (i.e. surface-area-to-mass-ratio) and larger particle size.

Figure 9:
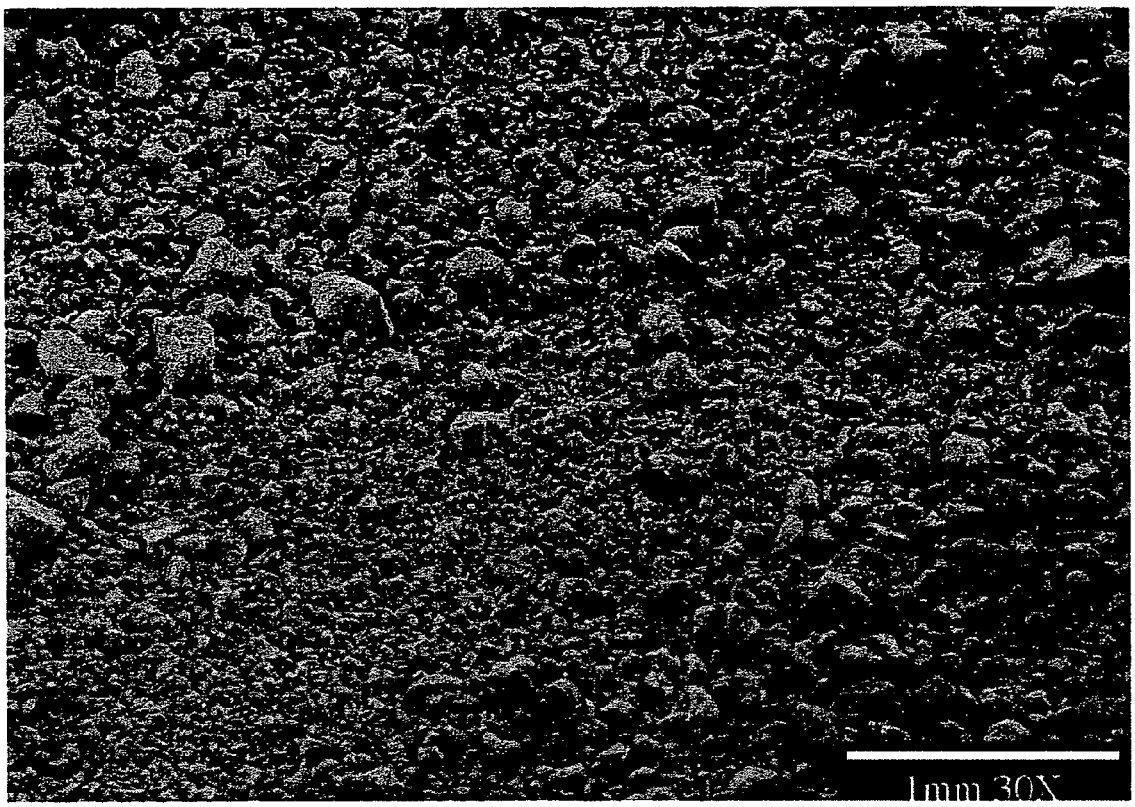
FIG. 9 is a scanning electron microscope image of the molybdenum metal powder such as may be produced according to one embodiment of the present invention wherein the ammonium molybdate precursor material is AOM.
Figure 10:
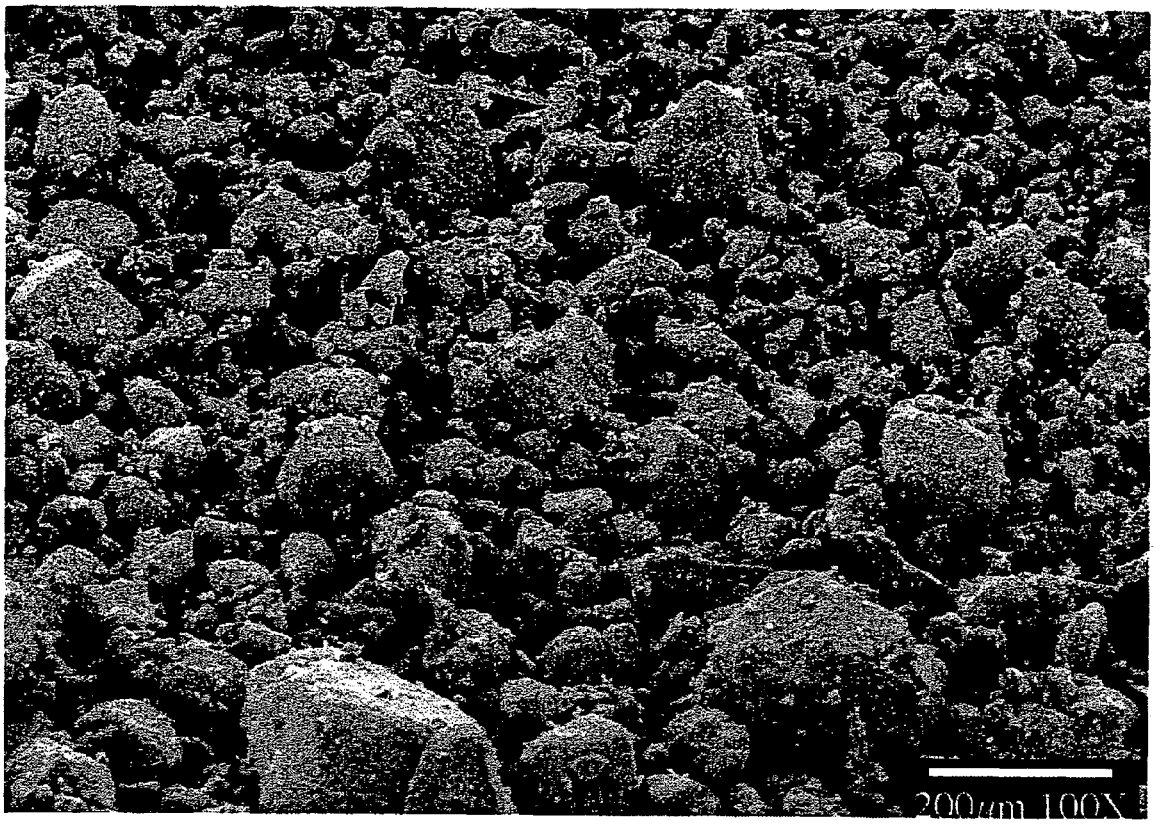
FIG. 10 is a scanning electron microscope image of the molybdenum metal powder such as may be produced according to one embodiment of the present invention wherein the ammonium molybdate precursor material is AOM.
Figure 11:
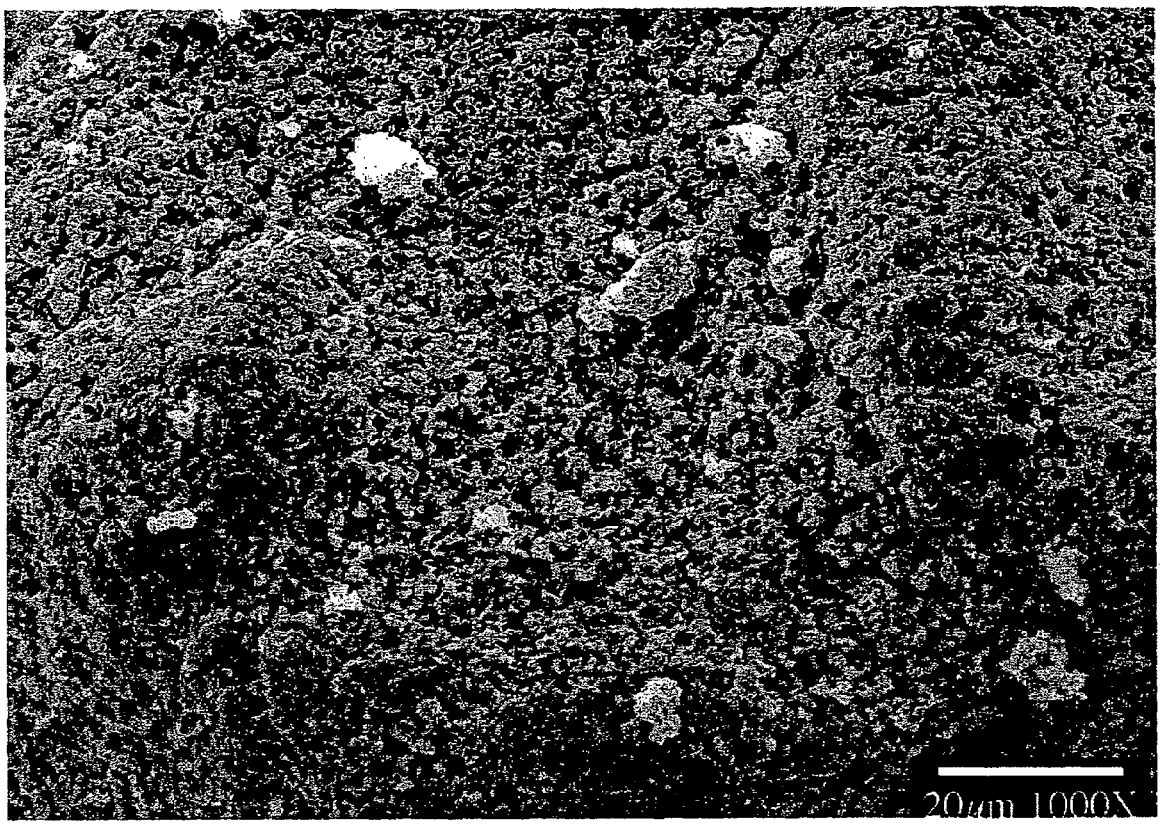
FIG. 11 is a scanning electron microscope image of the molybdenum metal powder such as may be produced according to one embodiment of the present invention wherein the ammonium molybdate precursor material is AOM.

FIGS. 9-11 are scanning electron microscope images of molybdenum metal powder 10 such as may be produced according to one embodiment of the present invention wherein the ammonium molybdate precursor material 24 was AOM. The AOM is produced by and is commercially available from Climax Molybdenum Company in Fort Madison, Iowa (CAS No: 12411-64-2).

Using AOM as the ammonium molybdate precursor material 24 generally results in a more coarse molybdenum metal power 10 than that produced from AHM, as seen in FIGS. 9 & 10. Molybdenum metal powder 10 produced from AOM also has a higher oxygen content and a lower flowability (as shown in Example 14) compared to molybdenum metal powder 10 produced from AHM. The porous surface of the molybdenum metal powder 10 produced from AOM increases the surface-area-to-mass-ratio and can readily been seen in FIG. 11. Generally, the molybdenum metal powder 10 produced from AOM has a combination of high BET (i.e. surface-area-to-mass-ratio) and larger particle size.

Selection of the ammonium molybdate precursor material 24 may depend on various design considerations, including but not limited to, the desired characteristics of the final molybdenum metal powder 10 (e.g., surface-area-to-mass-ratio, size, flowability, sintering ability, sintering temperature, final weight percent of oxygen, purity, etc.).

Apparatus for Producing Molybdenum Metal Powder

FIG. 1 is a schematic representation of an embodiment of an apparatus 12 used for producing molybdenum metal powder 10. This description of apparatus 12 provides the context for the description of the method 80 used to produce molybdenum metal powder 10.

Apparatus 12 may comprise a rotating tube furnace 14 having at least an initial heating zone 16 and a final heating zone 18. Optionally, the furnace 14 may also be provided with an intermediate heating zone 20 located between the initial heating zone 16 and the final heating zone 18. A process tube 22 extends through the furnace 14 so that an ammonium molybdate precursor material 24 may be introduced into the process tube 22 and moved through the heating zones 16, 18, 20 of the furnace 14, such as is illustrated by arrow 26 shown in FIG. 1. A process gas 28, such as a hydrogen reducing gas 30, may be introduced into the process tube 22, such as is illustrated by arrow 32 shown in FIG. 1.

The furnace 14 preferably comprises a chamber 34 formed therein. The chamber 34 defines a number of controlled heating zones 16, 18, 20 surrounding the process tube 22 within the furnace 14. The process tube 22 extends in approximately equal portions through each of the heating zones 16, 18, 20. The heating zones 16, 18, 20 are defined by refractory dams 36, 38. The furnace 14 may be maintained at the desired temperatures using any suitable temperature control apparatus (not shown). The heating elements 40, 42, 44 positioned within each of the heating zones 16, 18, 20 of the furnace 14, provide sources of heat.

The process gas 28 may comprise a reducing gas 30 and an inert carrier gas 46. The reducing gas 30 may be hydrogen gas, and the inert carrier gas 46 may be nitrogen gas. The reducing gas 30 and the inert carrier gas 46 may be stored in separate gas cylinders 30, 46 near the far end of the process tube 22, as shown in FIG. 1. The process gas 28 is introduced into the process tube 22 through gas inlet 72, and directed through the cooling zone 48 (illustrated by dashed outline in FIG. 1) and through each of the heating zones 16, 18, 20, in a direction opposite. (i.e., counter-current, as illustrated by arrow 32) to the direction that the precursor material 24 is moved through each of the heating zones 16, 18, 20, of the furnace 14.

The process gas 28 may also be used to maintain a substantially constant pressure within the process tube 22. In one embodiment of the invention, the process tube 22 may maintain water pressure at about 8.9 to 14 cm (about 3.5 to 5.5 in). The process tube 22 may be maintained at a substantially constant pressure by introducing the process gas 28 at a predetermined rate, or pressure, into the process tube 22, and discharging any unreacted process gas 28 at a predetermined rate, or pressure, therefrom to establish the desired equilibrium pressure within the process tube 22. The discharge gas may be bubbled through a water scrubber (not shown) to maintain the interior water pressure of the furnace 14 at approximately 11.4 cm (4.5 in).

Apparatus 12 may also comprise a transfer system 50. The transfer system 50 may also comprise a feed system 52 for feeding the ammonium molybdate precursor material 24 into the process tube 22, and a discharge hopper 54 at the far end of the process tube 22 for collecting the molybdenum metal powder 10 that is produced in the process tube 22.

The process tube 22 may be rotated within the chamber 34 of the furnace 14 via the transfer system 50 having a suitable drive assembly 56. The drive assembly 56 may be operated to rotate the process tube 22 in either a clockwise or counter-clockwise direction, as illustrated by arrow 58 in FIG. 1. The process tube 22 may be positioned at an incline 60 within the chamber 34 of the furnace 14.

The process tube 22 may be assembled on a platform 62, and the platform 62 may be hinged to a base 64 so that the platform 62 may pivot about an axis 66. A lift assembly 68 may also engage the platform 62. The lift assembly 68 may be operated to raise or lower one end of the platform 62 with respect to the base 64. The platform 62, and hence the process tube 22, may be adjusted to the desired incline with respect to the grade 70.

Although one embodiment of apparatus 12 is shown in FIG. 1 and has been described above, it is understood that other embodiments of apparatus 12 are also contemplated as being within the scope of the invention.

Method for Producing Molybdenum Metal Powder

A method 80 for production of the molybdenum metal powder 10 (described above) using apparatus 12 (described above) is disclosed herein and shown in FIG. 2. An embodiment of a method 80 for producing molybdenum metal powder 10 according to the present invention may be illustrated as steps in the flow chart shown in FIG. 2.

The method 80 generally begins with the ammonium molybdate precursor material 24 being introduced into the process tube 22, and moved through the each of the heating zones 16, 18, 20 of the furnace 14 (while inside the process tube 22). The process tube 22 may be rotating 58 and/or inclined 60 to facilitate movement and mixing of the ammonium molybdate precursor material 24 and the process gas 28. The process gas 28 flows through the process tube 22 in a direction that is opposite or counter-current (shown by arrow 32) to the direction that the ammonium molybdate precursor material 24 is moving through the process tube (shown by arrow 26). Having briefly described a general overview of the method 80, the method 80 will now be described in more detail.

The method begins by providing 82 a supply of an ammonium molybdate precursor material 24. The ammonium molybdate precursor material 24 is described below in more detail. The ammonium molybdate precursor material 24 may then be introduced (i.e. fed) into the process tube 22. The feed rate of the ammonium molybdate precursor material 24 may be commensurate with the size of the equipment (i.e. furnace 14) used.

Figure 2:
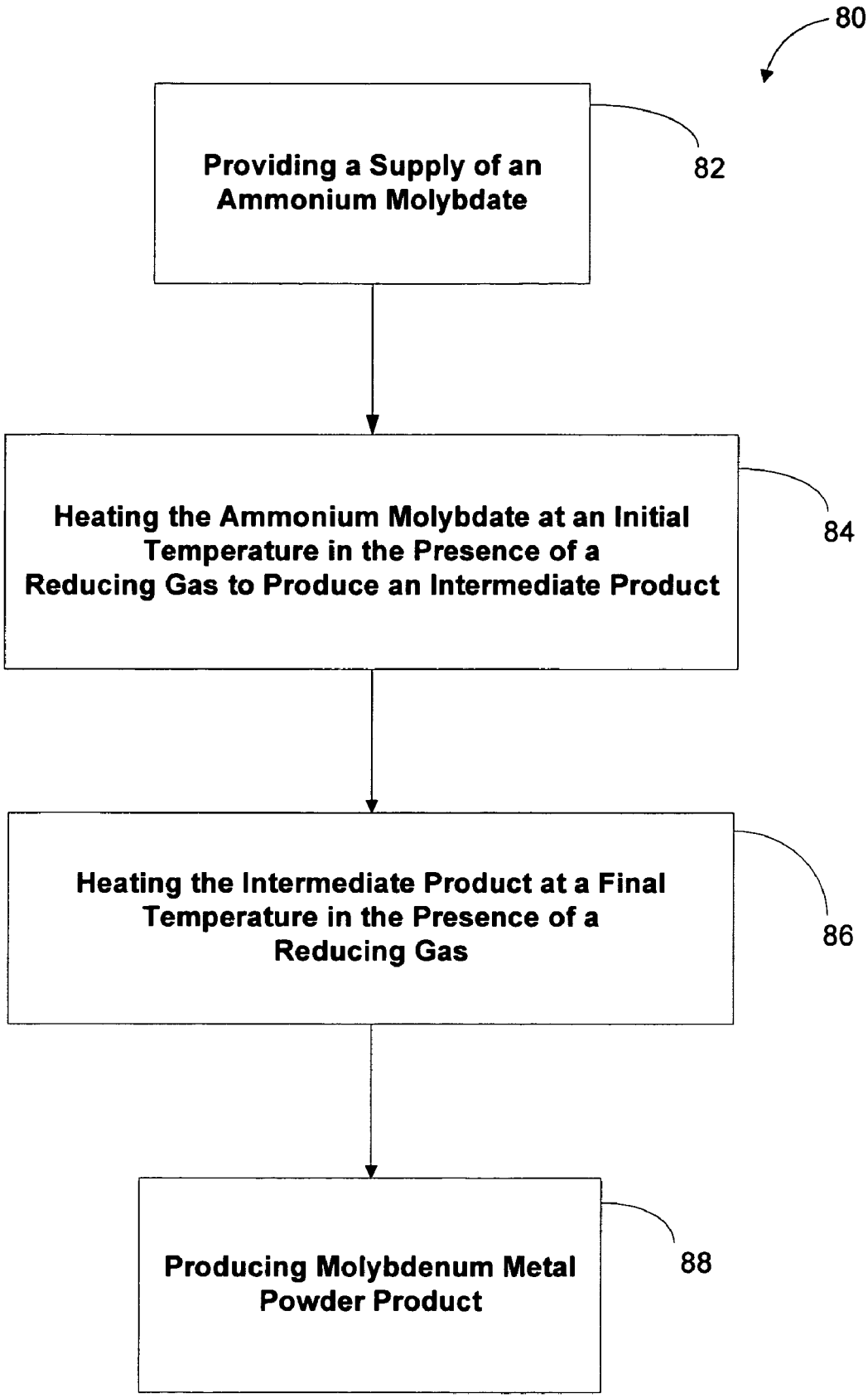
FIG. 2 is a flow chart illustrating an embodiment of a method for producing molybdenum metal powder according to the invention.

As shown in FIG. 2, the method 80 continues with heating 84 the ammonium molybdate precursor material 24 at an initial temperature in the presence of the process gas 28. As the ammonium molybdate precursor material 24 moves through the initial heating zone 16, it is mixed with the process gas 28 and reacts therewith to form an intermediate product 74 (shown in FIG. 1). The intermediate product 74 may be a mixture of unreacted ammonium molybdate precursor material 24, intermediate reaction products, and the molybdenum metal powder 10. The intermediate product 74 remains in the process tube 22 and continues to react with the process gas 28 as it is moved through the heating zones 16, 18, 20.

More specifically, the reaction in the initial zone 16 may be the reduction of the ammonium molybdate precursor material 24 by the reducing gas 30 (e.g., hydrogen gas) in the process gas 28 to form intermediate product 74. The reduction reaction may also produce water vapor and/or gaseous ammonia when the reducing gas 30 is hydrogen gas. The chemical reaction occurring in initial zone 16 between the ammonium molybdate precursor material 24 and reducing gas 30 is not fully known. However, it is generally believed that the chemical reaction occurring in initial zone 16 includes the reduction or fuming-off of 60%-70% of the gaseous ammonia, reducing to hydrogen gas and nitrogen gas, resulting in more available hydrogen gas, thus requiring less fresh hydrogen gas to be pumped into the process tube 22.

The temperature in the initial zone 16 may be maintained at a constant temperature of about 600° C. The ammonium molybdate precursor material 24 may be heated in the initial zone 16 for about 40 minutes. The temperature of the initial zone 16 may be maintained at a lower temperature than the temperatures of the intermediate 20 and final 18 zones because the reaction between the ammonium molybdate precursor material 24 and the reducing gas 30 in the initial zone 16 is an exothermic reaction. Specifically, heat is released during the reaction in the initial zone 16 and maintaining a temperature below 600° C. in the initial zone 16 helps to avoid fuming-off of molytrioxide ($MoO_3$).

The intermediate zone 20 may optionally be provided as a transition zone between the initial 16 and the final 18 zones. The temperature in the intermediate zone 20 is maintained at a higher temperature than the initial zone 16, but at a lower temperature than the final zone 18. The temperature in the intermediate zone 20 may be maintained at a constant temperature of about 770° C. The intermediate product 74 may be heated in the intermediate zone 20 for about 40 minutes.

The intermediate zone 20 provides a transition zone between the lower temperature of the initial zone 16 and the higher temperature of the final zone 18, providing better control of the size of the molybdenum metal power product 10. Generally, the reaction in the intermediate zone 20 is believed to involve a reduction reaction resulting in the formation or fuming-off of water vapor, gaseous ammonia, or gaseous oxygen, when the reducing gas 30 is hydrogen gas.

The method 80 continues with heating 86 the intermediate product 74 at a final temperature in the presence of a reducing gas 30. As the intermediate product 74 moves into the final zone 18, it continues to be mixed with the process gas 28 (including reducing gas 30) and reacts therewith to form the molybdenum metal powder 10. It is believed that the reaction in the final zone 18 is a reduction reaction resulting in the formation of solid molybdenum metal powder (Mo) 10 and, water or gaseous hydrogen and nitrogen, when the reducing gas 30 is hydrogen gas.

The reaction between the intermediate product 74 and the reducing gas 30 in the final zone 18 is an endothermic reaction resulting in the production 88 of molybdenum metal powder product 10. Thus, the energy input of the final zone 18 may be adjusted accordingly to provide the additional heat required by the endothermic reaction in the final zone 18. The temperature in the final zone 18 may be maintained at approximately 950° C., more specifically, at a temperature of about 946° C. to about 975° C. The intermediate product 74 may be heated in the final zone 18 for about 40 minutes.

Generally, the surface-area-to-mass-ratios (as determined by BET analysis) of the molybdenum metal powder 10 decrease with increasing final zone 18 temperatures. Generally, increasing the temperature of the final zone 18 increases agglomeration (i.e. "clumping") of the molybdenum metal powder 10 produced. While higher final zone 18 temperatures may be utilized, grinding or jet-milling of the molybdenum metal powder 10 may be necessary to break up the material for various subsequent sintering and other powder metallurgy applications.

The molybdenum metal powder 10 may also be screened to remove oversize particles from the product that may have agglomerated or "clumped" during the process. Whether the molybdenum metal powder 10 is screened will depend on design considerations such as, but not limited to, the ultimate use for the molybdenum metal powder 10, and the purity and/or particle size of the ammonium molybdate precursor material 24.

If the molybdenum metal powder 10 produced by the reactions described above is immediately introduced to an atmospheric environment while still hot (e.g., upon exiting final zone 18), it may react with oxygen in the atmosphere and reoxidize. Therefore, the molybdenum metal powder 10 may be moved through an enclosed cooling zone 48 after exiting final zone 18. The process gas 28 also flows through the cooling zone 48 so that the hot molybdenum metal powder 10 may be cooled in a reducing environment, lessening or eliminating reoxidation of the molybdenum metal powder 10 (e.g., to form $MoO_2$ and/or $MoO_3$). Additionally, the cooling zone 48 may also be provided to cool molybdenum metal powder 10 for handling purposes.

The above reactions may occur in each of the heating zones 16, 18, 20, over a total time period of about two hours. It is understood that some molybdenum metal powder 10 may be formed in the initial zone 16 and/or the intermediate zone 20. Likewise, some unreacted ammonium molybdate precursor material 24 may be introduced into the intermediate zone 20 and/or the final zone 18. Additionally, some reactions may still occur even in the cooling zone 46.

Having discussed the reactions in the various portions of process tube 22 in furnace 14, it should be noted that optimum conversions of the ammonium molybdate precursor material 24 to the molybdenum metal powder 10 were observed to occur when the process parameters were set to values in the ranges shown in Table 1 below.

TABLE 1

| PARAMETER | SETTING |
|---|---|
| Process Tube Incline | 0.25% |
| Process Tube Rotation Rate | 3.0 revolutions per minute |
| Temperature | |
| Initial Zone | about 600° C. |
| Intermediate Zone | about 750° C. |
| Final Zone | about 950° C.-1025° C. |

TABLE 1-continued

| PARAMETER | SETTING |
|---|---|
| Time | |
| Initial Zone | about 40 minutes |
| Intermediate Zone | about 40 minutes |
| Final Zone | about 40 minutes |
| Process Gas Flow Rate | 60 to 120 cubic feet per hour |

As will become apparent after studying Examples 1-14 below, the process parameters outlined in Table 1 and discussed above may be altered to optimize the characteristics of the desired molybdenum metal powder 10. Similarly, these parameters may be altered in combination with the selection of the ammonium molybdate precursor material 24 to further optimize the desired characteristics of the molybdenum metal powder 10. The characteristics of the desired molybdenum metal powder 10 will depend on design considerations such as, but not limited to, the ultimate use for the molybdenum metal powder 10, the purity and/or particle size of the ammonium molybdate precursor material 24, etc.

EXAMPLES 1 & 2

In these Examples, the ammonium molybdate precursor material 24 was ammonium heptamolybdate (AHM). The particles of AHM used as the ammonium molybdate precursor material 24 in this example are produced by and are commercially available from the Climax Molybdenum Company (Fort Madison, Iowa).

The following equipment was used for these examples: a loss-in-weight feed system 52 available from Brabender as model no. H31-FW33/50, commercially available from C.W. Brabender Instruments, Inc. (South Hackensack, N.J.); and a rotating tube furnace 14 available from Harper International Corporation as model no. HOU-6D60-RTA-28-F (Lancaster, N.Y.). The rotating tube furnace 14 comprised independently controlled 50.8 cm (20 in) long heating zones 16, 18, 20 with a 305 cm (120 in) HT alloy tube 22 extending through each of the heating zones 16, 18, 20 thereof. Accordingly, a total of 152 cm (60 in) of heating and 152 cm (60 in) of cooling were provided in this Example.

In these Examples, the ammonium molybdate precursor material 24 was fed, using the loss-in-weight feed system 52, into the process tube 22 of the rotating tube furnace 14. The process tube 22 was rotated 58 and inclined 60 (as specified in Table 2, below) to facilitate movement of the precursor material 24 through the rotating tube furnace 14, and to facilitate mixing of the precursor material 24 with a process gas 28. The process gas 28 was introduced through the process tube 22 in a direction opposite or counter-current 32 to the direction that the precursor material 24 was moving through the process tube 22. In these Examples, the process gas 28 comprised hydrogen gas as the reducing gas 30, and nitrogen gas as the inert carrier gas 46. The discharge gas was bubbled through a water scrubber (not shown) to maintain the interior of the furnace 14 at approximately 11.4 cm (4.5 in) of water pressure.

The rotating tube furnace 14 parameters were set to the values shown in Table 2 below.

TABLE 2

| PARAMETER | SETTING |
|---|---|
| Precursor Feed Rate | 5 to 7 grams per minute |
| Process Tube Incline | 0.25% |
| Process Tube Rotation | 3.0 revolutions per minute |
| Temperature Set Points | |
| Initial Zone | 600° C. |
| Intermediate Zone | 770° C. |
| Final Zone | 946° C.-975° C. |
| Time | |
| Initial Zone | 40 minutes |
| Intermediate Zone | 40 minutes |
| Final Zone | 40 minutes |
| Process gas Rate | 80 cubic feet per hour |

Molybdenum metal powder 10 produced according to these Examples is shown in FIGS. 3-5, and discussed above with respect thereto. Specifically, the molybdenum metal powder 10 produced according to these Examples is distinguished by its surface-area-to-mass-ratio in combination with its particle size and flowability. Specifically, the molybdenum metal powder 10 produced according to these Examples has surface-area-to-mass-ratios of 2.364 $m^2$/gm for Example 1, and 2.027 $m^2$/gm for Example 2, as determined by BET analysis. The molybdenum metal powder 10 produced according to these Examples has flowability of 63 s/50 g for Example 1 and 58 s/50 g for Example 2. The results obtained and described above for Examples 1 and 2 are also detailed in Table 3 below.

TABLE 3

| Example/ Final Zone | Surface-area-to-mass-ratio | Flowability | Final Weight | Particle Size Distribution by Standard Sieve Analysis | |
|---|---|---|---|---|---|
| Temp. (° C.) | ($m^2$/gm) | (s/50 g) | % Oxygen | +100 | −325 |
| 1/946° C. | 2.364 $m^2$/gm | 63 s/50 g | 0.219% | 39.5% | 24.8% |
| 2/975° C. | 2.027 $m^2$/gm | 58 s/50 g | 0.171% | 48.9% | 17.8% |

Example 1 results (listed above in Table 3) were obtained by averaging ten separate test runs. The detailed test run data for Example 1 is listed in Table 4 below. The final weight percent of oxygen in Example 1 was calculated by mathematically averaging each of the ten test runs. The surface-area-to-mass-ratio, flowability, and particle size distribution results were obtained after combining and testing the molybdenum powder products from the ten separate test runs.

Example 2 results (listed above in Table 3) were obtained by averaging sixteen separate test runs. The detailed test run data for Example 2 is also listed in Table 4 below. The final weight percent of oxygen in Example 2 was calculated by mathematically averaging each of the sixteen test runs. The surface-area-to-mass-ratio, flowability, and particle size distribution results were obtained after combining and testing the molybdenum powder products from the sixteen separate test runs.

TABLE 4

| Ex. # | Run # | Feed In (kg) | Feed In (g/min.) - | Tube Incline % | Tube Rotation (rpm) | Initial Zone Temp. ° C. | Intermediate Zone Temp. ° C. | Final Zone Temp. ° C. | Hydrogen Gas Flow (ft3/hr) | Net Weight (kg) | Final Weight % Oxygen |
|---|---|---|---|---|---|---|---|---|---|---|---|
| Ex. 1 | 1 | 2.415 | 8.05 | 0.25 | 3.00 | 600 | 770 | 946 | 80 | 0.900 | 0.190 |
| | 2 | 1.348 | 5.62 | 0.25 | 3.00 | 600 | 770 | 946 | 80 | 0.760 | 0.190 |
| | 3 | 1.494 | 6.22 | 0.25 | 3.00 | 600 | 770 | 946 | 80 | 0.760 | 0.170 |
| | 4 | 1.425 | 5.94 | 0.25 | 3.00 | 600 | 770 | 946 | 80 | 0.880 | 0.190 |
| | 5 | 1.689 | 7.04 | 0.25 | 3.00 | 600 | 770 | 946 | 80 | 0.560 | 0.280 |
| | 6 | 2.725 | 11.35 | 0.25 | 3.00 | 600 | 770 | 946 | 80 | 0.760 | 0.240 |
| | 7 | 1.492 | 6.22 | 0.25 | 3.00 | 600 | 770 | 946 | 80 | 0.580 | 0.250 |
| | 8 | 0.424 | 1.77 | 0.25 | 3.00 | 600 | 770 | 946 | 80 | 0.360 | 0.200 |
| | 9 | 1.752 | 7.30 | 0.25 | 3.00 | 600 | 770 | 946 | 80 | 1.140 | 0.260 |
| | 10 | 0.864 | 3.60 | 0.25 | 3.00 | 600 | 770 | 946 | 80 | 0.770 | 0.220 |
| Ex. 2 | 11 | 0.715 | 2.98 | 0.25 | 3.00 | 600 | 770 | 975 | 80 | 0.700 | 0.150 |
| | 12 | 2.575 | 10.73 | 0.25 | 3.00 | 600 | 770 | 975 | 80 | 0.600 | 0.220 |
| | 13 | 1.573 | 6.55 | 0.25 | 3.00 | 600 | 770 | 975 | 80 | 0.640 | 0.230 |
| | 14 | 1.376 | 5.73 | 0.25 | 3.00 | 600 | 770 | 975 | 80 | 0.640 | 0.200 |
| | 15 | 1.11 | 4.62 | 0.25 | 3.00 | 600 | 770 | 975 | 80 | 0.700 | 0.220 |
| | 16 | 1.53 | 6.37 | 0.25 | 3.00 | 600 | 770 | 975 | 80 | 0.720 | 0.140 |
| | 17 | 1.766 | 7.36 | 0.25 | 3.00 | 600 | 770 | 975 | 80 | 0.680 | 0.160 |
| | 18 | 2.038 | 8.49 | 0.25 | 3.00 | 600 | 770 | 975 | 80 | 0.780 | 0.160 |
| | 19 | 1.111 | 4.63 | 0.25 | 3.00 | 600 | 770 | 975 | 80 | 0.580 | 0.160 |
| | 20 | 1.46 | 6.08 | 0.25 | 3.00 | 600 | 770 | 975 | 80 | 0.760 | 0.200 |
| | 21 | 1.213 | 5.05 | 0.25 | 3.00 | 600 | 770 | 975 | 80 | 0.720 | 0.180 |
| | 22 | 1.443 | 6.01 | 0.25 | 3.00 | 600 | 770 | 975 | 80 | 1.060 | 0.150 |
| | 23 | 1.007 | 4.20 | 0.25 | 3.00 | 600 | 770 | 975 | 80 | 0.516 | 0.140 |
| | 24 | 1.848 | 7.70 | 0.25 | 3.00 | 600 | 770 | 975 | 80 | 0.700 | 0.150 |
| | 25 | 1.234 | 5.14 | 0.25 | 3.00 | 600 | 770 | 975 | 80 | 0.660 | 0.140 |
| | 26 | 0.444 | 1.85 | 0.25 | 3.00 | 600 | 770 | 975 | 80 | 0.620 | 0.140 |
| Ex. 3 | 27 | 2.789 | 11.60 | 0.25 | 3.00 | 600 | 770 | 950 | 80 | 1.880 | 0.278 |
| Ex. 4 | 28 | 4.192 | 14.00 | 0.25 | 3.00 | 600 | 770 | 1000 | 80 | 1.340 | 0.168 |
| | 29 | 2.709 | 15.00 | 0.25 | 3.00 | 600 | 770 | 1000 | 80 | 1.400 | 0.160 |
| | 30 | 3.21 | 13.40 | 0.25 | 3.00 | 600 | 770 | 1000 | 80 | 1.380 | 0.170 |
| | 31 | 2.545 | 10.60 | 0.25 | 3.00 | 600 | 770 | 1000 | 80 | 1.360 | 0.123 |

TABLE 4-continued

| Ex. # | Run # | Feed In (kg) | Feed In (g/min.) - | Tube Incline % | Tube Rotation (rpm) | Initial Zone Temp. ° C. | Intermediate Zone Temp. ° C. | Final Zone Temp. ° C. | Hydrogen Gas Flow (ft3/hr) | Net Weight (kg) | Final Weight % Oxygen |
|---|---|---|---|---|---|---|---|---|---|---|---|
| | 32 | 2.617 | 10.90 | 0.25 | 3.00 | 600 | 770 | 1000 | 80 | 1.260 | 0.117 |
| | 33 | 3.672 | 15.30 | 0.25 | 3.00 | 600 | 770 | 1000 | 80 | 1.200 | 0.173 |
| Ex. 5 | 34 | 2.776 | 11.60 | 0.25 | 3.00 | 600 | 770 | 1025 | 95 | 0.900 | 0.179 |
| | 35 | 2.949 | 12.30 | 0.25 | 3.00 | 600 | 770 | 1025 | 95 | 1.720 | 0.160 |
| | 36 | 3.289 | 13.70 | 0.25 | 3.00 | 600 | 770 | 1025 | 95 | 0.980 | 0.181 |
| | 37 | 2.329 | 9.70 | 0.25 | 3.00 | 600 | 770 | 1025 | 95 | 1.080 | 0.049 |
| | 38 | 2.19 | 9.10 | 0.25 | 3.00 | 600 | 770 | 1025 | 95 | 0.906 | 0.125 |
| Ex. 6 | 39 | 3.187 | 13.30 | 0.25 | 3.00 | 600 | 770 | 950 | 95 | 0.800 | 0.084 |
| | 40 | 3.048 | 12.70 | 0.25 | 3.00 | 600 | 770 | 950 | 95 | 0.676 | 0.203 |
| | 41 | 2.503 | 10.40 | 0.25 | 3.00 | 600 | 770 | 950 | 95 | 1.836 | 0.185 |
| | 42 | 2.266 | 9.40 | 0.25 | 3.00 | 600 | 770 | 950 | 95 | 1.112 | 0.194 |
| | 43 | −0.01 | −0.30 | 0.25 | 3.00 | 600 | 770 | 950 | 95 | 0.652 | 0.085 |

EXAMPLES 3-6

In Examples 3-6, the ammonium molybdate precursor material 24 was ammonium heptamolybdate (AHM). Examples 3-6 used the same ammonium molybdate precursor material 24, the same equipment, and the same process parameter settings as previously described above in detail in Examples 1 and 2. Examples 3-6 varied only the temperature of the final zone. The results obtained for Examples 3-6 are shown in Table 5 below.

TABLE 5

| Example/ Final Zone Temp. (° C.) | Surface-area-to-mass-ratio ($m^2$/gm) | Final Weight % Oxygen | Particle Size Distribution by Standard Sieve Analysis +100 | −325 |
|---|---|---|---|---|
| 3/950° C. | 2.328 $m^2$/gm | 0.278% | 37.1% | 21.6% |
| 4/1000° C. | 1.442 $m^2$/gm | 0.152% | 36.1% | 23.8% |
| 5/1025° C. | 1.296 $m^2$/gm | 0.139% | 33.7% | 24.2% |
| 6/950° C. | 1.686 $m^2$/gm | 0.150% | 34.6% | 27.8% |

Example 3 results (listed above in Table 5) were obtained from one separate test run. The detailed test run data for Example 3 is listed in Table 4 above. The final weight percent of oxygen, surface-area-to-mass-ratio, and particle size distribution results were obtained after testing the run data from the one test run.

Example 4 results (listed above in Table 5) were obtained by averaging six separate test runs. The detailed test run data for Example 4 is also listed in Table 4 above. The final weight percent of oxygen in Example 4 was calculated by mathematically averaging each of the six test runs. The surface-area-to-mass-ratio and particle size distribution results were obtained after combining and testing the molybdenum powder products from the six separate test runs.

Example 5 results (listed above in Table 5) were obtained by averaging five separate test runs. The detailed test run data for Example 5 is also listed in Table 4 above. The final weight percent of oxygen in Example 5 was calculated by mathematically averaging each of the five test runs. The surface-area-to-mass-ratio and particle size distribution results were obtained after combining and testing the molybdenum powder products from the five separate test runs.

Example 6 results (listed above in Table 5) were obtained by averaging five separate test runs. The detailed test run data for Example 6 is also listed in Table 4 above. The final weight percent of oxygen in Example 6 was calculated by mathematically averaging each of the five test runs. The surface-area-to-mass-ratio and particle size distribution results were obtained after combining and testing the molybdenum powder products from the five separate test runs.

EXAMPLES 7-12

In Examples 7-12, the ammonium molybdate precursor material 24 was ammonium heptamolybdate (AHM). Examples 7-12 used the same ammonium molybdate precursor material 24, the same equipment, and the same process parameter settings as previously described above in detail in Examples 1 and 2. Examples 7-12 varied in the temperatures of the intermediate and final zones. The temperatures of the intermediate and final zones and the results obtained for Examples 7-12 are shown in Table 6 below.

TABLE 6

| Example/ Intermediate Zone Temp./ Final Zone Temp. (° C.) | Surface-area-to-mass-ratio ($m^2$/gm) | Flowability (s/50 g) | Final Weight % Oxygen | Particle Size Distribution by Standard Sieve Analysis +100 | −325 |
|---|---|---|---|---|---|
| 7/ 770° C./ 950° C. | 1.79 $m^2$/gm | 52 s/50 g | 0.270% | 43.8% | 16.7% |
| 8/ 760° C./ 940° C. | 1.93 $m^2$/gm | 51 s/50 g | 0.290% | 51.1% | 13.7% |
| 9/ 750° C./ 930° C. | 1.95 $m^2$/gm | 57 s/50 g | 0.284% | 49.5% | 14.8% |
| 10/ 740° C./ 920° C. | 2.17 $m^2$/gm | 59 s/50 g | 0.275% | 43.8% | 17.2% |
| 11/ 730° C./ 910° C. | 2.95 $m^2$/gm | 61 s/50 g | 0.348% | 45.6% | 16.8% |
| 12/ 770° C./ 950° C. | 1.90 $m^2$/gm | 64 s/50 g | 0.242% | 50.3% | 12.5% |

Example 7 results (listed above in Table 6) were obtained by averaging nine separate test runs. The final weight percent of oxygen in Example 7 was calculated by mathematically averaging each of the nine test runs. The surface-area-to-mass-ratio, flowability, and particle size distribution results were obtained after combining and testing the molybdenum powder products from the nine separate test runs.

Example 8 results (listed above in Table 6) were obtained by averaging six separate test runs. The final weight percent of oxygen in Example 7 was calculated by mathematically averaging each of the six test runs. The surface-area-to-mass-ratio, flowability, and particle size distribution results were obtained after combining and testing the molybdenum powder products from the six separate test runs.

Example 9 results (listed above in Table 6) were obtained by averaging eight separate test runs. The final weight percent of oxygen in Example 7 was calculated by mathematically averaging each of the eight test runs. The surface-area-to-mass-ratio, flowability, and particle size distribution results were obtained after combining and testing the molybdenum powder products from the eight separate test runs.

Example 10 results (listed above in Table 6) were obtained by averaging seventeen separate test runs. The final weight percent of oxygen in Example 7 was calculated by mathematically averaging each of the seventeen test runs. The surface-area-to-mass-ratio, flowability, and particle size distribution results were obtained after combining and testing the molybdenum powder products from the seventeen separate test runs.

Example 11 results (listed above in Table 6) were obtained by averaging six separate test runs. The final weight percent of oxygen in Example 7 was calculated by mathematically averaging each of the six test runs. The surface-area-to-mass-ratio, flowability, and particle size distribution results were obtained after combining and testing the molybdenum powder products from the six separate test runs.

Example 12 results (listed above in Table 6) were obtained by averaging sixteen separate test runs. The final weight percent of oxygen in Example 7 was calculated by mathematically averaging each of the sixteen test runs. The surface-area-to-mass-ratio, flowability, and particle size distribution results were obtained after combining and testing the molybdenum powder products from the sixteen separate test runs.

EXAMPLE 13

In Example 13, the ammonium molybdate precursor material 24 was ammonium dimolybdate (ADM). Example 13 used the same equipment and process parameter settings as previously described above in detail in Examples 1 and 2, except that the temperature of the initial, intermediate, and final heating zones was kept at 600° C. The results obtained for Example 13 are shown in Table 7 below.

TABLE 7

| Example | Surface-area-to-mass-ratio ($m^2$/gm) | Flowability (s/50 g) | Final Weight % Oxygen | Particle Size Distribution by Standard Sieve Analysis +100 | −325 |
|---|---|---|---|---|---|
| 13 | 1.58 $m^2$/gm | 78 s/50 g | 1.568% | 52.2% | 8.9% |

Example 13 results (listed above in Table 7) were obtained by averaging four separate test runs. The final weight percent of oxygen in Example 13 was calculated by mathematically averaging each of the four test runs. The surface-area-to-mass-ratio, flowability, and particle size distribution results were obtained after combining and testing the molybdenum powder products from the four separate test runs.

EXAMPLE 14

In Example 14, the ammonium molybdate precursor material 24 was ammonium octamolybdate (AOM). Example 14 used the same equipment and process parameter settings as previously described above in detail in Examples 1 and 2, except that the temperatures of the intermediate and final heating zones were varied. In Example 14 the intermediate heating zone was set between 750° C.-800° C. and the final heating zone was set between 900° C.-1000° C. The results obtained for Example 14 are shown in Table 8 below.

TABLE 8

| Example | Surface-area-to-mass-ratio ($m^2$/gm) | Flowability (s/50 g) | Final Weight % Oxygen | Particle Size Distribution by Standard Sieve Analysis +100 | −325 |
|---|---|---|---|---|---|
| 14 | 2.00 $m^2$/gm | >80 s/50 g (No Flow) | 0.502% | 61.4% | 8.6% |

Example 14 results (listed above in Table 8) were obtained by averaging eleven separate test runs. The final weight percent of oxygen in Example 14 was calculated by mathematically averaging each of the eleven test runs. The surface-area-to-mass-ratio, flowability, and particle size distribution results were obtained after combining and testing the molybdenum powder products from the eleven separate test runs.

As will be understood by those skilled in the art after reviewing the above Examples, the selection of an ammonium molybdate precursor material 24 will depend on the intended use for the molybdenum metal power 10. As previously discussed, the selection of the ammonium molybdate precursor material 24 may depend on various design considerations, including but not limited to, the desired characteristics of the molybdenum metal powder 10 (e.g., surface-area-to-mass-ratio, size, flowability, sintering ability, sintering temperature, final weight percent of oxygen, purity, etc.).

It is readily apparent that the molybdenum metal powder 10 discussed herein has a relatively large surface-area-to-mass-ratio in combination with large particle size. Likewise, it is apparent that apparatus 12 and methods 80 for production of molybdenum metal powder 10 discussed herein may be used to produce molybdenum metal powder 10. Consequently, the claimed invention represents an important development in molybdenum metal powder technology.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

What is claimed is:

1. A molybdenum metal powder, comprising:

a surface-area-to-mass-ratio between about 1.0 $m^2$/g and about 3.0 $m^2$/g, as determined by BET analysis; and a flowability of between about 58 s/50 g and about 63 s/50 g, as determined by a Hall Flowmeter.

2. The molybdenum metal powder of claim 1, wherein the surface-area-to-mass-ratio is between about 1.32 $m^2$/g and 2.56 $m^2$/g, as determined by BET analysis.

3. The molybdenum metal powder of claim 1, wherein the molybdenum metal powder begins to sinter at about 950° C.

4. The molybdenum metal powder of claim 1, having a weight percent of oxygen less than about 0.2%.

5. The molybdenum metal powder of claim 1, wherein at least 30% of the molybdenum metal powder particles have a particle size larger than a size +100 standard Tyler mesh sieve.

6. The molybdenum metal powder of claim 5, wherein at least 40% of the molybdenum metal powder particles have a particle size larger than a size +100 standard Tyler mesh sieve.

7. The molybdenum metal powder of claim 1, wherein at least 20% of the molybdenum metal powder particles have a particle size smaller than a size −325 standard Tyler mesh sieve.

8. A method of producing molybdenum metal powder, comprising:

providing a supply of ammonium molybdate;

heating the ammonium molybdate at an initial temperature in the presence of a reducing gas to produce an intermediate product; and heating the intermediate product at a final temperature in the presence of the reducing gas. creating a molybdenum metal powder having a surface-area-to-mass-ratio between about 1.0 $m^2/g$ and about 3.0 $m^2/g$, as detennined by BET analysis, and flowability between about 58 s/50 g and about 63 s/50 g, as determined by a Hall Flowmeter.

9. The method of claim 8, wherein the surface-area-to-mass-ratio of the molybdenum metal powder is between about 1.32 m2/g and about 2.56 m2/g, as determined by BET analysis.

10. The method of claim 8, wherein heating the ammonium molybdate at the initial temperature and heating the intermediate product at the final temperature comprises heating for about two hours.

11. The method of claim 8, wherein heating the ammonium molybdate at the initial temperature comprises heating at about 600° C.

12. The method of claim 8, wherein heating the ammonium molybdate at the initial temperature comprises heating for about 40 minutes.

13. The method of claim 8, wherein heating the intermediate product at the final temperature comprises heating at about 950° C.

14. The method of claim 8, wherein heating the intermediate product at the final temperature comprises heating for about 40 minutes.

15. The method of claim 8, further comprising heating the intermediate product at an intermediate temperature before heating the intermediate product at the final temperature.

16. The method of claim 8, wherein heating the intermediate product at the intermediate temperature comprises heating at about 750° C.

17. A method of producing molybdenum metal powder, comprising:

providing a supply of ammonium molybdate; heating the ammonium molybdate at an initial temperature in the presence of a reducing gas to produce an intermediate product;

heating the intermediate product at an intermediate temperature for about 40 minutes before heating the intermediate product at a final temperature; and heating the intermediate product at the final temperature in the presence of the reducing gas, creating a molybdenum metal powder having a surface-area-to-mass-ratio between about 1.0 $m^2/g$ and about 3.0 $m^2/g$, as determined by BET analysis, and flowabilitv between about 29 s/50 g and about 64 s/50 g, as determined by a Hall Flowmeter.

18. The method of claim 17, wherein providing a supply of ammonium molybdate comprises providing a supply of ammonium dimolybdate (ADM).

19. The method of claim 17, wherein providing a supply of ammonium molybdate comprises providing a supply of ammonium heptamolybdate (AHM).

20. The method of claim 17, wherein providing a supply of ammonium molybdate comprises providing a supply of ammonium octamolybdate (AOM).

* * * * *